US008550789B2

(12) United States Patent
Hu et al.

(10) Patent No.: US 8,550,789 B2
(45) Date of Patent: Oct. 8, 2013

(54) LINEAR COMPRESSOR

(75) Inventors: Jin Seok Hu, Masna-si (KR); Shin Hyun Park, Pusan (KR); Young Geul Kim, Pusan (KR); Kyo Lyong Kang, Changyeong-gun (KR)

(73) Assignee: LG Electronics Inc., Seoul (KR)

( * ) Notice: Subject to any disclaimer, the term of this patent is extended or adjusted under 35 U.S.C. 154(b) by 271 days.

(21) Appl. No.: 13/133,074

(22) PCT Filed: Feb. 22, 2011

(86) PCT No.: PCT/KR2011/001124
§ 371 (c)(1),
(2), (4) Date: Jun. 6, 2011

(87) PCT Pub. No.: WO2011/105720

PCT Pub. Date: Sep. 1, 2011

(65) Prior Publication Data

US 2012/0034104 A1 Feb. 9, 2012

(30) Foreign Application Priority Data

Feb. 26, 2010 (KR) ..... 10-2010-0017940

(51) Int. Cl.

| | |
|---|---|
| ***F04B 49/06*** | (2006.01) |
| ***F04B 35/04*** | (2006.01) |
| ***F04B 17/04*** | (2006.01) |
| ***H02K 33/12*** | (2006.01) |
| ***H02K 41/02*** | (2006.01) |

(52) U.S. Cl.
USPC ..... 417/44.11; 417/416; 318/119; 318/135; 318/687

(58) Field of Classification Search
USPC ..... 318/38, 119, 135, 687; 417/44.1, 45, 417/44.11, 53, 415, 416, 417, 902
See application file for complete search history.

(56) References Cited

U.S. PATENT DOCUMENTS 6,537,034 B2 * 3/2003 Kim et al. ..... 417/44.1
6,616,415 B1 9/2003 Renken et al.
(Continued)

FOREIGN PATENT DOCUMENTS

JP 2003-028073 1/2003
JP 2003-293962 10/2003
(Continued)

OTHER PUBLICATIONS

International Search Report dated Nov. 29, 2011. (PCT/KR2011/001124) (English Translation).
International Search Report dated Nov. 29, 2011. (PCT/KR2011/001124).

*Primary Examiner* — Devon Kramer
*Assistant Examiner* — Bryan Lettman
(74) *Attorney, Agent, or Firm* — KED & Associates LLP

(57) ABSTRACT

The present invention discloses a linear compressor which makes it possible to precisely operate a voltage using a current without having a high-capacity capacitor connected in series to a motor. The linear compressor comprises a mechanical unit including a fixed member having a compression space therein, a movable member linearly reciprocated in the fixed member to compress a refrigerant sucked into the compression space, one or more springs provided to elastically support the movable member in the motion direction of the movable member, and a motor connected to the movable member to linearly reciprocate the movable member in the axial direction, and an electric control unit including a rectification unit receiving AC power and outputting a DC voltage, an inverter unit receiving the DC voltage, converting the DC voltage to an AC voltage according to a control signal, and supplying the AC voltage to the motor, a current sensing unit sensing a current flowing between the motor and the inverter unit, an integrator circuit unit integrating a voltage corresponding to the current from the current sensing unit, and a control unit receiving an integrated value from the integrator circuit unit and controlling the AC voltage applied to the motor to permit the reciprocation of the movable member.

15 Claims, 8 Drawing Sheets

(56) References Cited

U.S. PATENT DOCUMENTS

| | | | | |
|---|---|---|---|---|
| 6,869,272 | B2 | 3/2005 | Odachi et al. | |
| 2011/0061411 | A1 * | 3/2011 | Kim et al. | 62/132 |

FOREIGN PATENT DOCUMENTS

| | | |
|---|---|---|
| JP | 2008-196320 | 8/2008 |
| KR | 10-2009-0090248 | 8/2009 |

* cited by examiner

- Conventional Art -

- Conventional Art -

- Conventional Art -

LINEAR COMPRESSOR

TECHNICAL FIELD

The present invention relates to a linear compressor, and, more particularly, to a linear compressor which makes it possible to precisely operate a voltage using a current without having a high-capacity capacitor connected in series to a motor.

BACKGROUND ART

In general, a motor is provided in a compressor which is a mechanical apparatus for receiving power from a power generation apparatus, such as an electric motor, a turbine, etc. and compressing the air, refrigerant or other various operating gases to raise a pressure. The motor has been widely used in electric home appliances such as refrigerators, air conditioners, etc., and its application has been expanded to the whole industry.

In particular, the compressors are roughly classified into a reciprocating compressor in which a compression space for sucking and discharging an operating gas is defined between a piston and a cylinder so that the piston can be linearly reciprocated in the cylinder to compress a refrigerant, a rotary compressor in which a compression space for sucking and discharging an operating gas is defined between an eccentrically-rotated roller and a cylinder so that the roller can be eccentrically rotated along the inner wall of the cylinder to compress a refrigerant, and a scroll compressor in which a compression space for sucking and discharging an operating gas is defined between an orbiting scroll and a fixed scroll so that the orbiting scroll can be rotated along the fixed scroll to compress a refrigerant.

Recently, a linear compressor which not only improves a compression efficiency but also has a simple structure has been actively developed among the reciprocating compressors. In particular, the linear compressor does not have a mechanical loss caused by a motion conversion since a piston is directly connected to a linearly-reciprocating driving motor.

FIG. 1 is a block diagram of a motor control device used in a conventional linear compressor.

As illustrated in FIG. 1, the motor control device includes a rectification unit having a diode bridge 11 receiving, rectifying and outputting AC power which is commercial power and a capacitor Cl smoothing the rectified voltage, an inverter unit 12 receiving a DC voltage, converting the DC voltage to an AC voltage according to a control signal from a control unit 17, and supplying the AC voltage to a motor unit, the motor unit having a motor 13 and a capacitor C2 connected in series to the motor 13, a voltage sensing unit 14 sensing a both-end voltage of the capacitor C1, a current sensing unit 15 sensing a current flowing through the motor unit, an operation unit 16 operating a counter electromotive force (EMF) from the voltage sensed by the voltage sensing unit 14 and the current sensed by the current sensing unit 15, and the control unit 17 generating a control signal by reflecting the counter EMF from the operation unit 16 and the current sensed by the current sensing unit 15.

In the conventional linear compressor shown in FIG. 1, additional costs and space are needed because the high-capacity capacitor C2 connected in series to the motor 13 is provided in the linear compressor. In addition, although the cooling capacity variability characteristics based on the load are determined by the capacity of the capacitor C2, in the prior art, it is not easy to change the capacity of the capacitor C2.

Moreover, the preparation and selective connection of a plurality of capacitors cause difficulties in terms of cost, space, and design.

FIG. 2 is a graph showing changes of a stroke and an input voltage of the motor of FIG. 1. In the conventional linear compressor, if the capacitor C2 is removed in a simple manner, as shown in FIG. 2, a phenomenon in which a voltage applied to the motor is reduced, i.e., a jump phenomenon occurs near the top dead center (TDC), so that the cooling capacity variability (under stroke operation) is impossible. In the graph of FIG. 2, the closer to 0.00, the closer to the TDC.

It is also essential to precisely set an initial current value so as to calculate the counter EMF or voltage by integrating the current from the current sensing unit which senses the current flowing through the motor unit.

FIG. 3 is a graph showing a conventional current integration curve. As shown in FIG. 3, initial current values at the peak of the current i can be set as points A, B, and C. Here, point C corresponds to the actual peak of the current i, point B has a smaller value than point C, and point A has a smaller value than point B.

Consequently, when a voltage Va graph in which point A has been set as a peak, a voltage Vb graph in which point B has been set as a peak, and a voltage Vc graph in which point C has been set as a peak are compared with one another, the integrated values have the highest peak in the voltage Va graph, the second highest peak in the voltage Vb graph, and the lowest peak in the voltage Vc graph. That is, how the initial value at the current peak is set makes a significant difference in the integrated voltage. Accordingly, if the initial value at the current peak is not appropriate, the integrated current values are not suitable for the use in precise control because offset values are continuously accumulated.

DISCLOSURE OF THE INVENTION

An object of the present invention is to provide a linear compressor which makes it possible to control the variable rate (or modulation) of the cooling capacity without having a capacitor connected to a motor of the linear compressor.

Another object of the present invention is to provide a linear compressor which can prevent a stroke jump phenomenon which may occur during the control of the linear compressor.

A further object of the present invention is to provide a linear compressor which makes it possible to precisely operate a voltage by removing a DC component resulting from offset accumulation, while operating the voltage using a current.

A still further object of the present invention is to provide a linear compressor which makes it possible to simply and precisely perform, via hardware, a process of operating a voltage using a current.

According to an aspect of the present invention, there is provided a linear compressor comprising: a mechanical unit including a fixed member having a compression space therein, a movable member linearly reciprocated in the fixed member to compress a refrigerant sucked into the compression space, one or more springs provided to elastically support the movable member in the motion direction of the movable member, and a motor connected to the movable member to linearly reciprocate the movable member in the axial direction; and an electric control unit including a rectification unit receiving AC power and outputting a DC voltage, an inverter unit receiving the DC voltage, converting the DC voltage to an AC voltage according to a control signal, and supplying the AC voltage to the motor, a current sensing unit sensing a current flowing between the motor and the inverter unit, an integrator circuit unit integrating a voltage corresponding to the current from the current sensing unit, and a control unit receiving an integrated value from the integrator circuit unit and controlling the AC voltage applied to the motor to permit the reciprocation of the movable member.

In addition, the control unit may generate a control signal for producing an AC voltage, which corresponds to a difference between a set voltage and an attenuation voltage corresponding to the integrated value, and apply the control signal to the inverter unit.

Moreover, the control unit may operate the attenuation voltage by multiplying the integrated value by a constant 1/Cr.

Additionally, the control unit may adjust a variable rate (or modulation) of a cooling capacity by varying the constant 1/Cr.

Further, the integrator circuit unit may include an integration unit receiving a reference voltage Vref which is greater than 0 V and outputting an integrated value varied about the reference voltage Vref.

Furthermore, the integration unit may include an amplifier which has an inverting input terminal receiving the voltage from the current sensing unit and a non-inverting input terminal receiving the reference voltage Vref, and a capacitor and a resistor connected in parallel to feed an output voltage from the amplifier back to the inverting input terminal.

Still furthermore, a cut-off frequency determined by the capacitor and the resistor connected in parallel may be set lower than a current frequency or an operating frequency.

Still furthermore, the integrator circuit unit may include a voltage amplification unit amplifying a voltage corresponding to the current from the current sensing unit and a coupling unit cutting off a DC offset contained in an output voltage from the voltage amplification unit, prior to the integration unit, and provide an output from the coupling unit as an input to the inverting input terminal of the integration unit.

Still furthermore, the integrator circuit unit may include a low-pass filter unit removing noise contained in an output voltage from the integration unit.

According to another aspect of the present invention, there is provided a method for controlling a linear compressor which includes a fixed member having a compression space therein, a movable member provided in the fixed member to compress a refrigerant sucked into the compression space, one or more springs provided to elastically support the movable member, and a motor connected to the movable member to linearly reciprocate the movable member in the axial direction, the method including: a first step of applying a preset application voltage to the motor; a second step of generating a first input voltage corresponding to a current produced by the application of the preset application voltage; a third step of calculating a first output voltage by integrating the first input voltage; a fourth step of calculating a first attenuation voltage by attenuating the first output voltage at a given ratio; a fifth step of calculating a first motor application voltage corresponding to a difference between the application voltage and the first attenuation voltage; and a sixth step of applying the first motor application voltage to the motor.

According to the present invention, it is possible to control the cooling capacity variability and the cooling capacity variability rate without having the capacitor connected to the motor of the linear compressor.

In addition, according to the present invention, it is possible to prevent the stroke jump phenomenon which may occur during the control of the linear compressor.

Moreover, according to the present invention, it is possible to precisely operate the voltage by removing the DC component resulting from offset accumulation, while operating the voltage using the current. Thus, precise motor control can be realized and fluctuation can be prevented.

Further, according to the present invention, it is possible to simply and precisely perform, via hardware, the process of operating the voltage using the current.

BEST MODE FOR CARRYING OUT THE INVENTION

Hereinafter, exemplary embodiments of the present invention will be described in detail with reference to the attached drawings.

Figure 1:
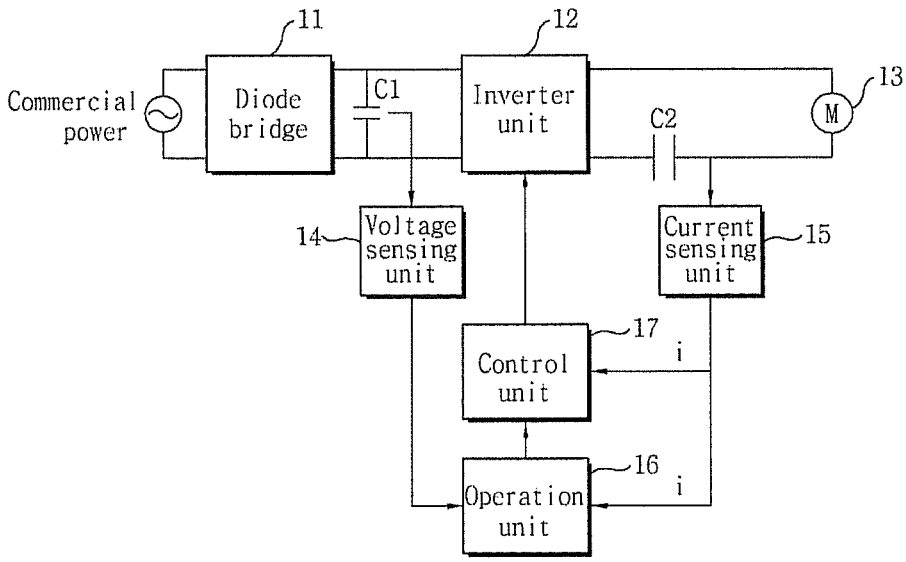
FIG. 1 is a block diagram of a motor control device used in a conventional linear compressor.
Figure 2:
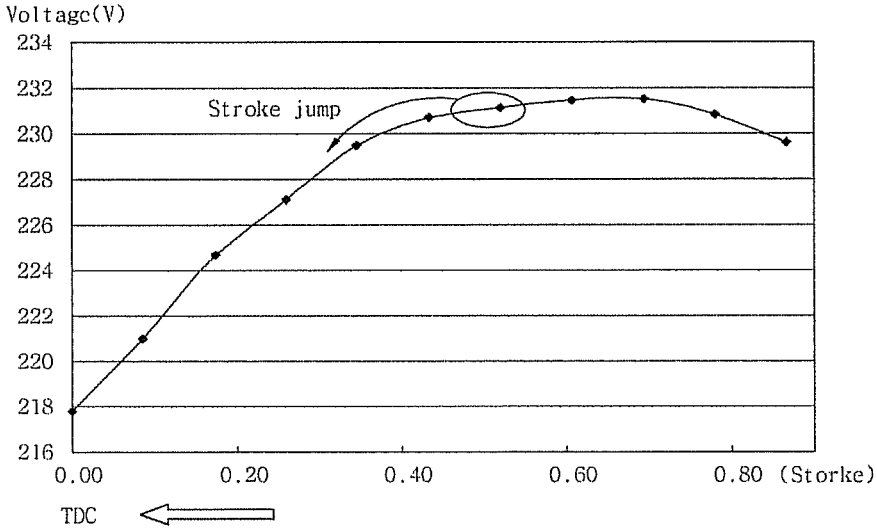
FIG. 2 is a graph showing changes of a stroke and an input voltage of the motor of FIG. 1.
Figure 3:
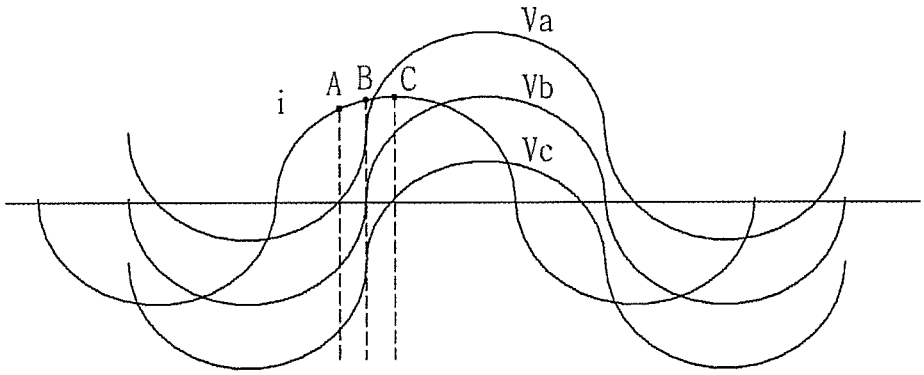
FIG. 3 is a graph showing a conventional current integration curve.
Figure 4:
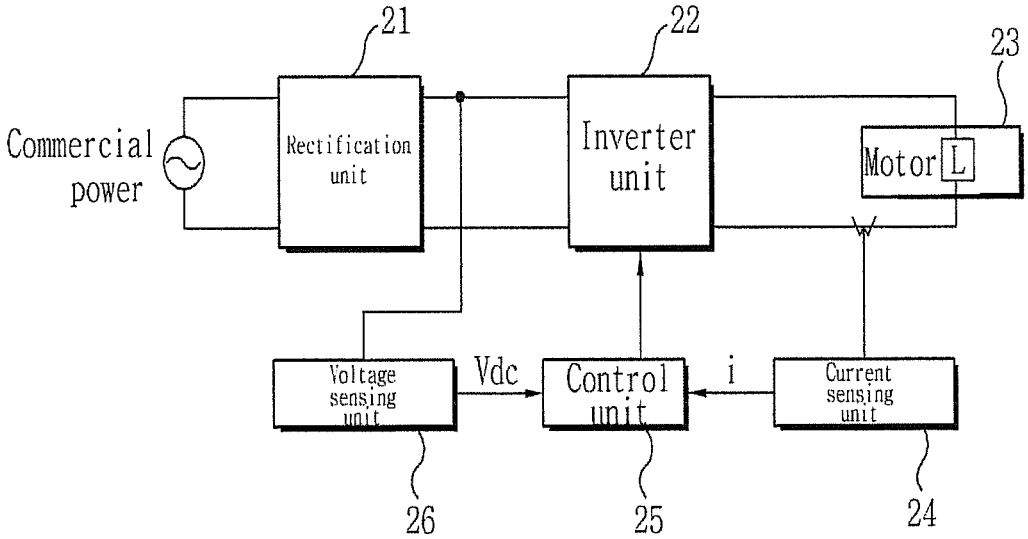
FIG. 4 is a block diagram of a control mechanism of a linear compressor according to a first embodiment of the present invention.
Figure 5:
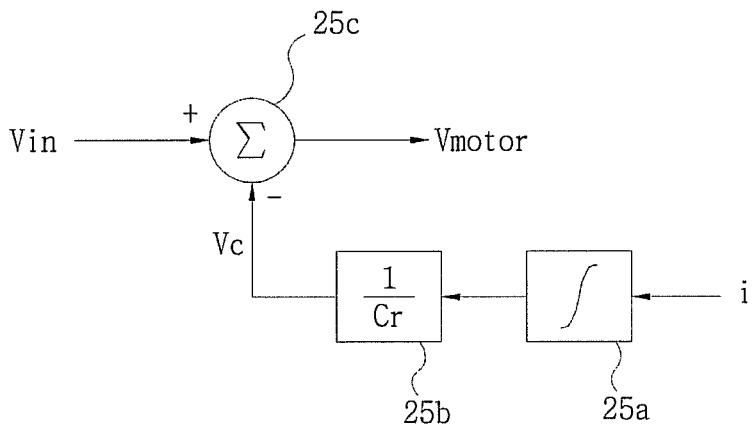
FIG. 5 is a circuit diagram of a control example of a control unit of FIG. 4.

FIG. 4 is a block diagram of a control mechanism of a linear compressor according to a first embodiment of the present invention, and FIG. 5 is a circuit diagram of a control example of a control unit of FIG. 4.

As illustrated in FIG. 4, the control mechanism of the linear compressor includes a rectification unit 21 receiving, rectifying, smoothing, and outputting AC power which is commercial power, an inverter unit 22 receiving a DC voltage, converting the DC voltage to an AC voltage according to a control signal from a control unit 25, and supplying the AC voltage to a motor 23, the motor 23 including a coil L, a current sensing unit 24 sensing a current flowing between the motor 23 and the inverter unit 22 or a current flowing through the coil L in the motor 23, the control unit 25 operating a motor application voltage Vmotor to be applied to the motor 23, based on the current sensed by the current sensing unit 24, generating a control signal for varying a frequency of the motor application voltage Vmotor according to load conditions, and applying the control signal to the inverter unit 22, and a voltage sensing unit 26 sensing the magnitude of the DC voltage from the rectification unit 21. However, in this control mechanism, the structure for supplying a required voltage to the control unit 25, the current sensing unit 24, the voltage sensing unit 26, etc. is obvious to a person of the ordinary skill in the art to which the present invention pertains, and thus a description thereof will be omitted.

The rectification unit 21 is composed of a diode bridge performing a general rectification function, a capacitor smoothing the rectified voltage, and so on.

The inverter unit 22, which is a means for receiving a DC voltage, generating an AC voltage, and applying the AC voltage to the motor 23, includes an IGBT element which is a switching element, a gate control unit turning on/off the IGBT element according to a control signal from the control unit 25, and so on. The inverter unit 22 is easily recognized by a person of the ordinary skill in the art to which the present invention pertains, and thus a description thereof will be omitted.

The motor 23 includes the coil L like a general motor of other mechanical structures but does not include a capacitor unlike the prior art.

The current sensing unit 24 is an element for sensing a current flowing through a conductive line between the inverter unit 22 and the motor 23 or a current flowing through the coil L of the motor 23.

The voltage sensing unit 26 is an element for sensing a DC voltage output from the rectification unit 21. Here, the voltage sensing unit 26 can sense the entire DC voltage or a DC voltage reduced at a given ratio.

The control unit 25 generates a control signal for transferring a preset application voltage Vin to the motor 23 and applies the control signal to the inverter unit 22, if it receives a linear compressor starting command from the outside or receives AC commercial power. As a result, the inverter unit 22 generates an AC voltage corresponding to the application voltage Vin and applies the AC voltage to the motor 23.

The current sensing unit 24 senses a current i flowing from the inverter unit 22 to the motor 23 or a current i flowing through the coil L of the motor 23 by the application of this AC voltage.

The control unit 25 receives the current i from the current sensing unit 24 and performs the processing shown in FIG. 4.

The control unit 25 includes an integrator 25*a* integrating the current i from the current sensing unit 24, an attenuator 25*b* operating an attenuation voltage Vc by multiplying the integrated value by a constant 1/Cr, and an operation unit 25*c* operating a difference between the set application voltage Vin and the attenuation voltage Vc. The application voltage Vin of this embodiment, which corresponds to the voltage applied by the inverter unit in the conventional compressor, is fixed or varied according to the control algorithm of the linear compressor.

The integrator 25*a* and the attenuator 25*b* correspond to the attenuation operation unit which attenuates the inductance effect of the coil L of the motor, using the current i flowing through the motor 23. That is, in this embodiment, since there is no capacitor connected to the coil L of the motor 23, the inductance effect of the coil L is reduced by controlling the motor application voltage Vmotor applied to the motor 23.

In addition, the constant 1/Cr used in the attenuator 25*b* may be fixedly or variably set according to the size of the coil L of the motor 23. For example, when an LC resonance frequency is set to be equal to a mechanical resonance frequency of the compressor, the constant 1/Cr may be determined accordingly. Or, if the LC resonance frequency is set to be higher or lower than the mechanical resonance frequency of the compressor, the constant 1/Cr may be determined accordingly.

As such, after the motor application voltage Vmotor is operated, the control unit 25 generates a control signal for controlling the inverter unit 22 to transfer the operated motor application voltage Vmotor to the motor 23 and applies the control signal to the inverter unit 22. That is, the control unit 25 allows the sensed current i to be fed back to the motor application voltage Vmotor, so that the operation of the motor 23 can be controlled in a state where the capacitor is not connected to the motor 23. In the present invention, since the counter electromotive force (EMF) is reflected to the current i and fed back, it needs not to be considered separately. Thereafter, the control unit 25 repeatedly calculates and applies the motor application voltage Vmotor according to a difference between the application voltage Vin which is an initial voltage and an attenuation voltage which is obtained by integrating the current produced by the applied motor application voltage Vmotor (e.g., a first attenuation voltage by the application voltage Vin, a second attenuation voltage by the primarily-calculated motor application voltage Vmotor, etc.).

The higher the load, the greater the motor application voltage Vmotor which is the required voltage. In the present invention, if the motor application voltage Vmotor (i.e., the maximum value) which is the required voltage is smaller than the DC voltage Vdc, a low load or a mid load is determined. In the case of the low load or the mid load, the inverter unit 22 applies an AC voltage (motor application voltage Vmotor) having a magnitude equal to or smaller than the DC voltage Vdc to the motor 23. Hence, the control unit 25 can maintain the required cooling capacity by controlling the magnitude of the AC voltage applied from the inverter unit 22 to the motor 23.

Further, the control unit 25 can attain a required high cooling capacity by changing the frequency of the motor application voltage Vmotor from the inverter unit 22, e.g., by increasing the frequency at a high load.

Figure 6:
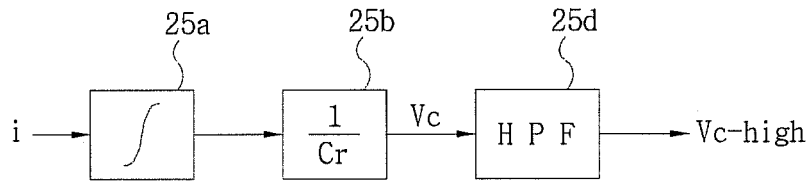
FIG. 6 is a circuit diagram of another control example of the control unit of FIG. 4.

FIG. 6 is a circuit diagram of another control example of the control unit of FIG. 4. In FIG. 6, a high-pass filter (HPF) unit 25*d* is provided. The reason for this is because the control unit 25 may mistakenly select the peak of the current i, in which case the offset is accumulated by the integration of the mistakenly-selected current, to thereby generate a DC component. The HPF unit 25*d* serves to remove this DC component.

The integrator 25*a* and the attenuator 25*b* are represented by the following Formula 1 which is a transfer function:

$$\frac{1}{Cr}\frac{1}{s} \qquad \text{Formula 1}$$

The HPF 25*d* is represented by the following Formula 2 which is a transfer function:

$$\frac{sRC}{sRC+1} \qquad \text{Formula 2}$$

wherein R denotes a resistance value and C denotes a capacitance.

This HPF unit 25*d* may be composed of a plurality of high-pass filters connected in series.

Figure 7:
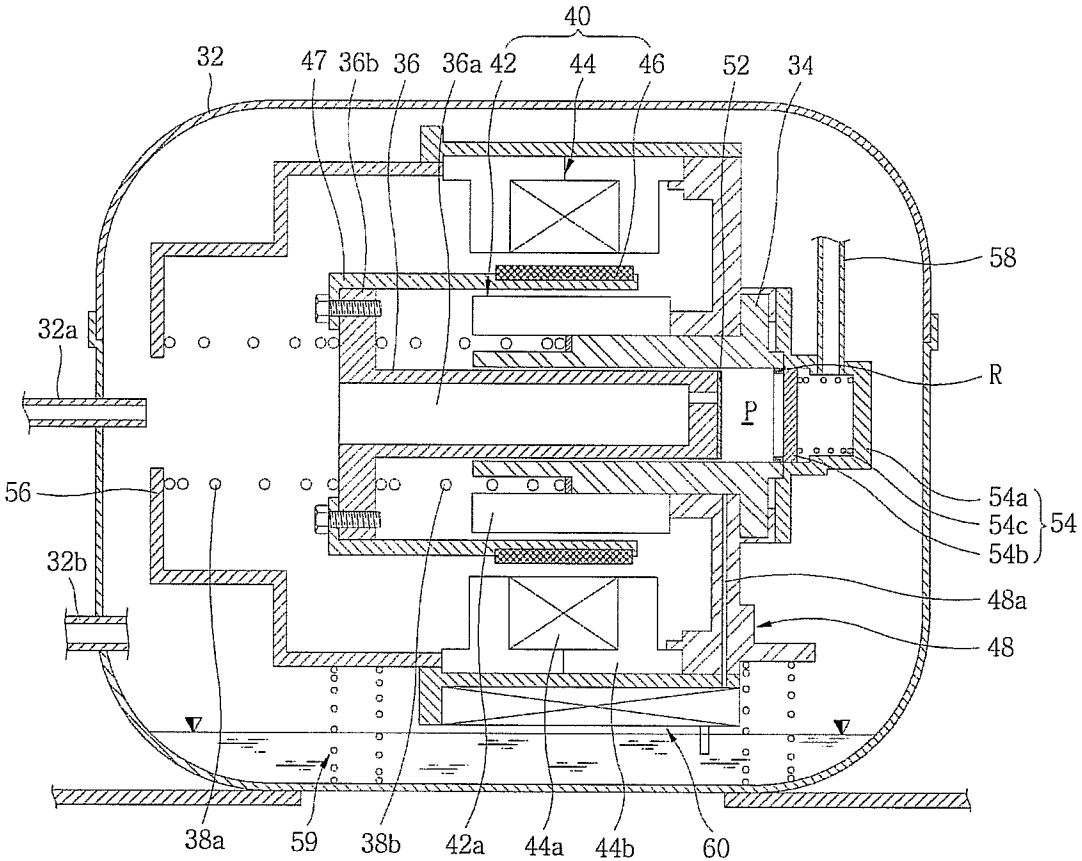
FIG. 7 is a structure diagram of the linear compressor according to the present invention.

FIG. 7 is a structure diagram of the linear compressor according to the present invention. As illustrated in FIG. 7, in the linear compressor according to the present invention, an inlet pipe 32*a* and an outlet pipe 32*b* through which a refrigerant flows in and out are provided at one side of a hermetic container 32, a cylinder 34 is fixedly installed in the hermetic container 32, a piston 36 is provided to be linearly reciprocated in the cylinder 34 to be able to compress the refrigerant sucked into a compression space P in the cylinder 34, and various springs are provided to elastically support the piston 36 in the motion direction of the piston 36. The piston 36 is provided to be connected to a linear motor 40 which produces a linear reciprocation driving force. Although a natural frequency fn of the piston 36 is changed according to a load, the linear motor 40 induces a natural output change which varies the cooling capacity (output) according to the changed load.

Moreover, a suction valve 52 is provided at one end of the piston 36 which is in contact with the compression space P and a discharge valve assembly 54 is provided at one end of the cylinder 34 which is in contact with the compression space P. The suction valve 52 and the discharge valve assembly 54 are automatically opened and closed according to the pressure inside the compression space P, respectively.

Here, the hermetic container 32 has its upper and lower shells coupled to each other to seal up the inside, the inlet pipe 32*a* for introducing the refrigerant and the outlet pipe 32*b* for discharging the refrigerant are provided at one side of the hermetic container 32, the piston 36 is elastically supported in the motion direction to be linearly reciprocated in the cylinder 34, and the linear motor 40 is coupled to the outside of the cylinder 34 by a frame 48 to constitute an assembly. This assembly is provided on the inside bottom surface of the hermetic container 32 to be elastically supported by supporting springs 59.

Further, given oil is filled in the inside bottom surface of the hermetic container 32, an oil supply apparatus 60 pumping the oil is provided at a bottom end of the assembly, and an oil supply pipe 48*a* is provided in the frame 48 on the lower side of the assembly to be able to supply the oil between the piston 36 and the cylinder 34. Therefore, the oil supply apparatus 60 pumps out the oil due to the vibration caused by linear reciprocation of the piston 36, so that the oil is supplied to a gap between the piston 36 and the cylinder 34 along the oil supply pipe 48*a* and performs cooling and lubricating functions.

Next, it is preferable that the cylinder 34 should be formed in a hollow shape so that the piston 36 can be linearly reciprocated in the cylinder 34, have the compression space P at its one side, and be disposed in alignment with the inlet pipe 32*a* when its one end is positioned closely to the inside of the inlet pipe 32*a*.

Of course, the piston 36 is provided at one end of the cylinder 34 close to the inlet pipe 32*a* to be linearly reciprocated in the cylinder 34, and the discharge valve assembly 54 is provided at the other end of the cylinder 34 opposite to the inlet pipe 32*a*.

Here, the discharge valve assembly 54 includes a discharge cover 54*a* provided to define a given discharge space at a one-end side of the cylinder 34, a discharge valve 54*b* provided to open and close one end of the cylinder 34 near the compression space P, and a valve spring 54*c* which is a kind of coil spring applying an elastic force between the discharge cover 54*a* and the discharge valve 54*b* in the axial direction. An O-ring R is fitted into the inner circumference of one end of the cylinder 34 so that the discharge valve 54*a* can be closely attached to the one end of the cylinder 34.

Moreover, a bent loop pipe 58 is connected between one side of the discharge cover 54*a* and the outlet pipe 32*b*. The loop pipe 58 not only guides the compressed refrigerant to be discharged to the outside, but also prevents vibration produced by interactions between the cylinder 34, the piston 36 and the linear motor 40 from being transferred to the entire hermetic container 32.

Accordingly, as the piston 36 is linearly reciprocated in the cylinder 34, if the pressure inside the compression space P exceeds a given discharge pressure, the valve spring 54*c* is compressed to open the discharge valve 54*b*, so that the refrigerant is completely discharged from the compression space P to the outside along the loop pipe 58 and the outlet pipe 32*b*.

Next, a refrigerant passage 36*a* is defined in the center of the piston 36 so that the refrigerant introduced from the inlet pipe 32*a* can flow therethrough, the linear motor 40 is connected directly to one end of the piston 36 close to the inlet pipe 32*a* by a connection member 47, and the suction valve 52 is provided at the other end of the piston 36 opposite to the inlet pipe 32*a*. The piston 36 is elastically supported in its motion direction by various springs.

Here, the suction valve 52 is formed in a thin plate shape with its central portion partially cut away to open and close the refrigerant passage 36*a* of the piston 36 and with its one side fixed to one end of the piston 36 by screws.

Therefore, as the piston 36 is linearly reciprocated in the cylinder 34, if the pressure of the compression space P becomes equal to or lower than a given suction pressure which is lower than a discharge pressure, the suction valve 52 is open, so that the refrigerant is sucked into the compression space P, and if the pressure of the compression space P exceeds the given suction pressure, the refrigerant is compressed in the compression space P with the suction valve 52 closed.

Particularly, the piston 36 is elastically supported in its motion direction. Specifically, a piston flange 36*b* protruding in the radial direction from one end of the piston 36 close to the inlet pipe 32*a* is elastically supported in the motion direction of the piston 36 by mechanical springs 38*a* and 38*b* such as coil springs, and the refrigerant contained in the compression space P on the opposite side to the inlet pipe 32*a* operates as a gas spring due to its own elastic force, thereby elastically supporting the piston 36.

Here, the mechanical springs 38*a* and 38*b* have a constant mechanical spring constant Km regardless of the load. It is preferable that the mechanical springs 38*a* and 38*b* should be provided respectively on the cylinder 34 and a given supporting frame 56 fixed to the linear motor 40 side by side in the axial direction, based on the piston flange 36*b*. It is preferable that the mechanical spring 38*a* supported on the supporting frame 56 and the mechanical spring 38*b* provided on the cylinder 34 should have the same mechanical spring constant Km.

However, the gas spring has a gas spring constant Kg changed according to the load. As the ambient temperature rises, the pressure of the refrigerant increases, and thus a own elastic force of the gas contained in the compression space P increases. Therefore, the higher the load, the larger the gas spring constant Kg of the gas spring.

Here, while the mechanical spring constant Km is constant, the gas spring constant Kg is changed according to the load. As a result, the entire spring constant is changed according to the load, and the natural frequency fn of the piston 36 is also changed according to the gas spring constant Kg.

Accordingly, even if the load is changed, the mechanical spring constant Km and the mass M of the piston 36 are constant, but the gas spring constant Kg is changed, so that the natural frequency fn of the piston 36 is significantly influenced by the gas spring constant Kg depending upon the load.

Of course, the load can be measured in various ways. However, since the linear compressor includes a freezing/air conditioning cycle for compressing, condensing, evaporating and expanding the refrigerant, the load can be defined as a difference between a condensation pressure at which the refrigerant is condensed and an evaporation pressure at which the refrigerant is evaporated, and further is determined in consideration of an average pressure which is an average of the condensation pressure and the evaporation pressure so as to improve the accuracy.

That is, the load is calculated to be proportional to the difference between the condensation pressure and the evaporation pressure and the average pressure thereof. The higher the load, the larger the gas spring constant Kg. For example, the larger the difference between the condensation pressure and the evaporation pressure, the higher the load. Although the difference between the condensation pressure and the evaporation pressure is the same, the higher the average pressure, the higher the load. The gas spring constant Kg is calculated so that it can be increased according to such a load. The linear compressor may include a sensor (pressure sensor, temperature sensor, etc.) to calculate the load.

Here, a condensation temperature substantially proportional to the condensation pressure and an evaporation temperature substantially proportional to the evaporation pressure are measured, and then the load is calculated to be proportional to a difference between the condensation temperature and the evaporation temperature and an average temperature thereof.

Specifically, the mechanical spring constant Km and the gas spring constant Kg can be determined by means of various experiments. If the ratio of the gas spring constant Kg to the entire spring constant increases, a resonance frequency of the piston 36 can be changed in a relatively wide range according to the load.

The linear motor 40 includes an inner stator 42 configured in a manner that a plurality of laminations 42*a* are stacked in the circumferential direction and fixed to the outside of the cylinder 34 by the frame 48, an outer stator 44 configured in a manner that a plurality of laminations 44*b* are stacked in the circumferential direction around a coil winding body 44*a* wound with a coil and provided outside the cylinder 34 by the frame 48 with a given gap from the inner stator 42, and a permanent magnet 46 positioned in the gap between the inner stator 42 and the outer stator 44 and connected to the piston 36 by the connection member 47. The coil winding body 44*a* may be fixed to the outside of the inner stator 42.

The linear motor 40 is one embodiment of the motor 23 described above.

Figure 8:
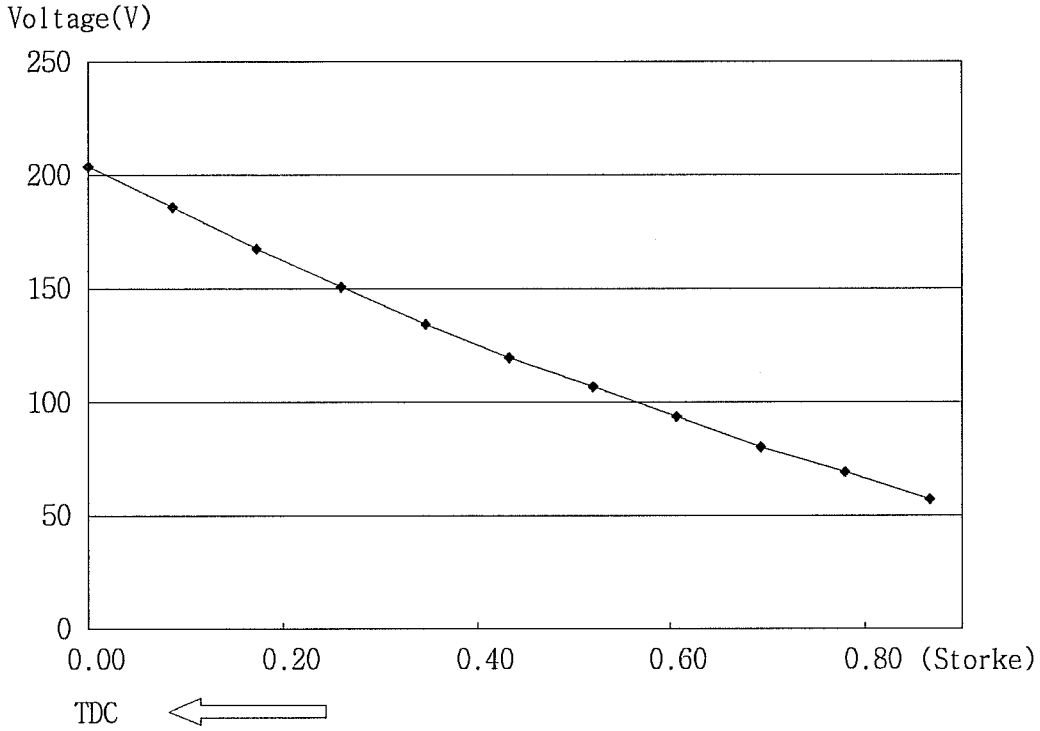
FIG. 8 is a graph showing changes of a stroke and an input voltage of a motor in the linear compressor according to the present invention.

FIG. 8 is a graph showing changes of a stroke and an input voltage of the motor in the linear compressor according to the present invention.

As illustrated in FIG. 8, in the linear compressor according to the present invention, even if the piston 36 approaches the top dead center, the input voltage of the motor rises, and thus the stroke jump phenomenon does not occur. Therefore, the linear compressor according to the present invention can perform the variability of the cooling capacity in a stable state. That is, the control unit 25 can perform the variability (or modulation) of the natural cooling capacity by the reciprocation of the piston 36 according to the load, by controlling the AC voltage applied to the motor 23 so that the stroke of the piston 36 can be proportional to the magnitude of the AC voltage applied to the motor 23.

In particular, the stroke of the piston 36 is proportional to the magnitude of the AC voltage applied to the motor 23 at least in close proximity to the top dead center of the piston 36, thereby preventing the stroke jump phenomenon.

Figure 9:
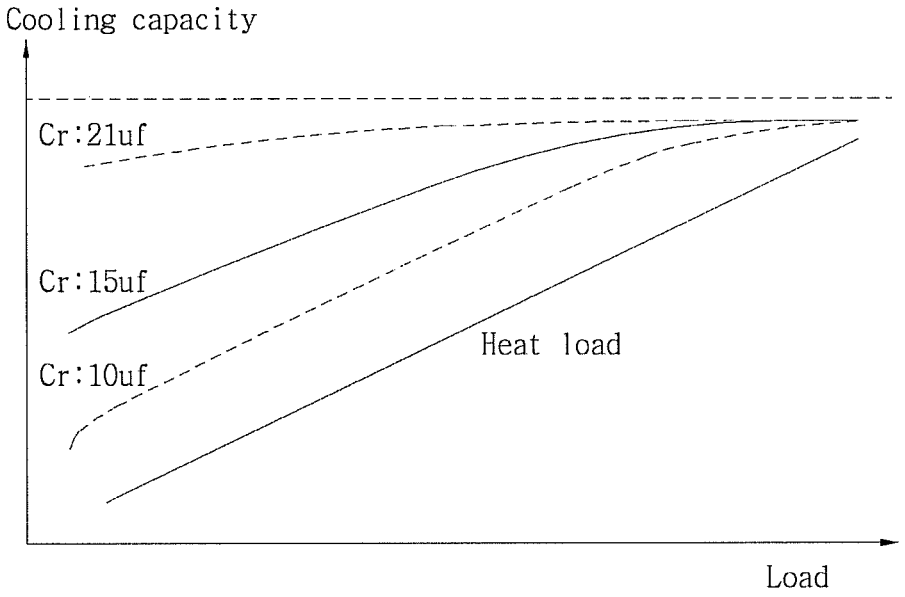
FIG. 9 is a graph showing changes of a cooling capacity and a load in the linear compressor according to the present invention.

FIG. 9 is a graph showing changes of the cooling capacity and the load in the linear compressor according to the present invention.

The, control unit 25 stores a variable constant 1/Cr. Referring to FIG. 9, in the case of Cr(10 μF), it can be seen that the cooling capacity of the linear compressor is changed according to the load.

As the value of Cr or 1/Cr varies, the cooling capacity variability rate is changed as shown in FIG. 9.

Accordingly, the control unit 25 according to the present invention can control the cooling capacity variability rate by changing the constant 1/Cr or Cr.

As Cr varies, a phase difference between the motor application voltage Vmotor and the current i decreases at a low load, so that a higher cooling capacity can be accomplished at the same load. That is, the LC resonance frequency is determined by the value of Cr, and the phases of the motor application voltage Vmotor and the current i are determined at a certain load. Here, if Cr varies, the phases of the motor application voltage Vmotor and the current i are changed, and thus the entire power is changed. In other words, the cooling capacity increases or decreases, so that the natural cooling capacity variability (modulation) rate is changed.

Figure 10:
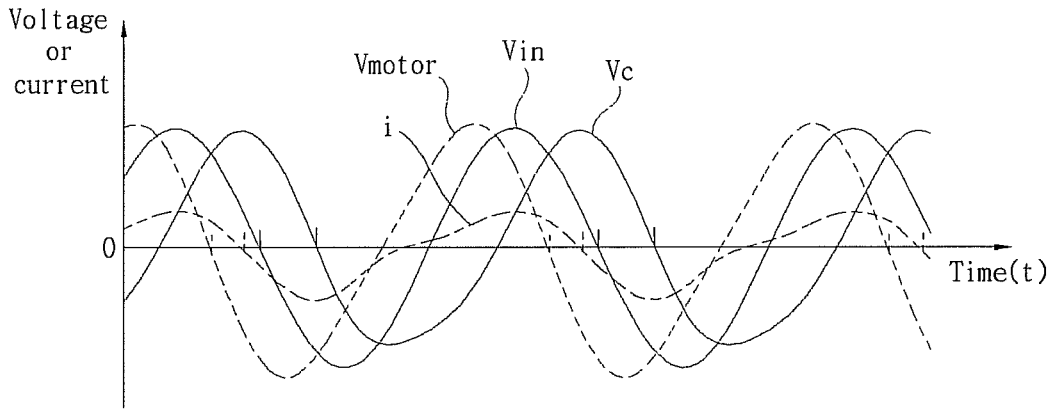
FIG. 10 is a graph showing voltages of the linear compressor according to the present invention.

FIG. 10 is a graph showing voltages of the linear compressor according to the present invention. As shown, the actual motor application voltage Vmotor is operated by subtracting the attenuation voltage Vc operated from the current i from the application voltage Vin. The motor application voltage Vmotor becomes equal to a voltage applied to a motor in a circuit in which a plurality of capacitors are connected in series to a coil L. As a result, the linear compressor can control the cooling capacity variability.

The above-described control operation by the control unit shown in FIGS. 4 to 6 is significantly influenced by A/D resolution of a microprocessor constituting the control unit 25. The output from the integrator 25*a* may be fluctuated by about 2 V to 30 V, which leads to fluctuation of the cooling capacity itself. The following hardware-type integration device can be further employed to solve these problems.

Figure 11:
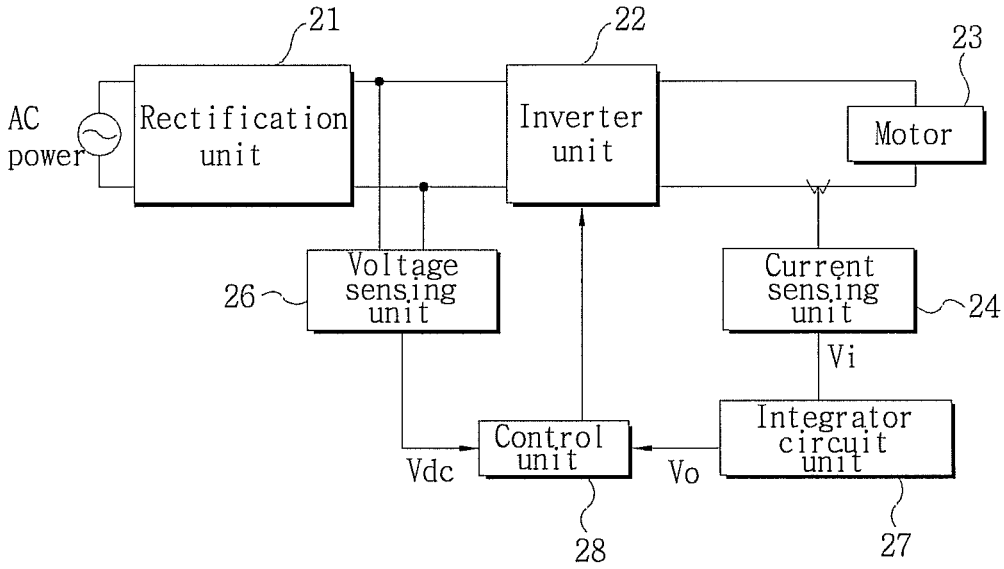
FIG. 11 is a block diagram of a control mechanism of a linear compressor according to a second embodiment of the present invention.
Figure 12:
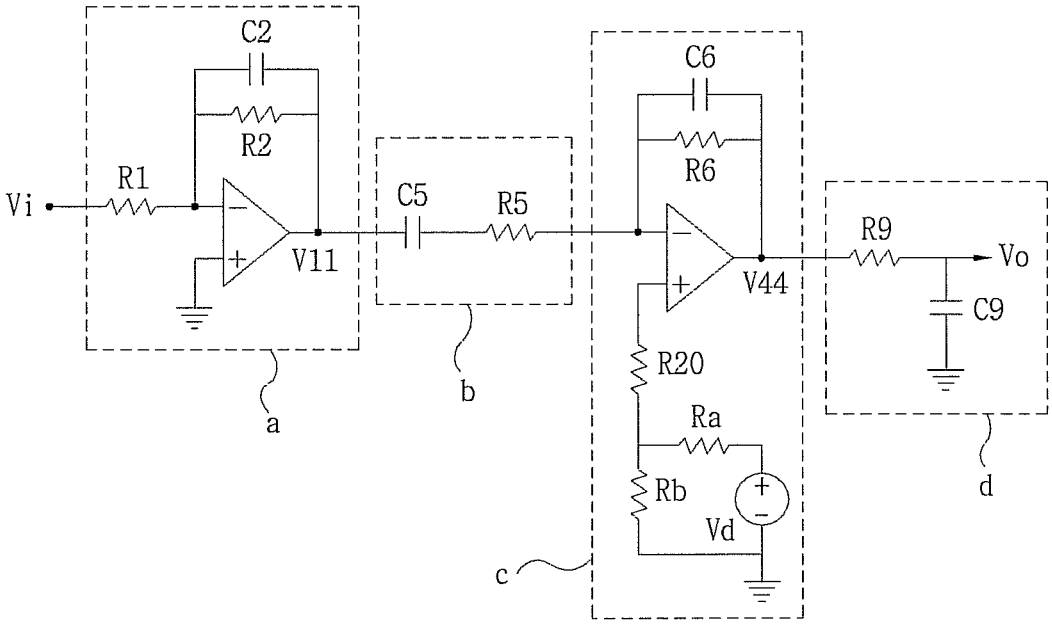
FIG. 12 is a detailed circuit diagram of an integrator circuit unit of FIG. 11.

FIG. 11 is a block diagram of a control mechanism of a linear compressor according to a second embodiment of the present invention, and FIG. 12 is a detailed circuit diagram of an integrator circuit unit of FIG. 11.

AC power, a rectification unit 21, an inverter unit 22, a motor 23, a current sensing unit 24 and a voltage sensing unit 26 in the control mechanism of FIG. 11 have the same circuit configuration and function as those in the control mechanism of FIG. 4 designated with identical reference numerals.

A control device (electric control unit) of FIG. 11 includes an integrator circuit unit 27 receiving an input voltage Vi from the current sensing unit 24 that corresponds to the current flowing through the motor 23, integrating the input voltage Vi, and applying an output voltage Vo to a control unit 28, and the control unit 28 receiving the output voltage Vo from the integrator circuit unit 27 and the voltage from the voltage sensing unit 26 and generating a control signal for controlling the inverter unit 22 to produce a motor application voltage Vmotor. Also in this embodiment, a power supply unit for supplying a DC voltage or the like to drive the control unit 28, the inverter unit 22, etc. is provided. Its structure and function are obvious to a person of the ordinary skill in the art to which the present invention pertains, and thus will not be described further.

As illustrated in FIG. 12, the integrator circuit unit 27 includes a voltage amplification unit a amplifying the input voltage Vi from the current sensing unit 24, a coupling unit b cutting off a DC offset contained in an output voltage V11 from the voltage amplification unit a, a hardware-type integration unit c receiving an output voltage from the coupling unit b and integrating the output voltage, and a low-pass filter (LPF) unit d removing noise contained in an output voltage V44 from the integration unit c.

In detail, the voltage amplification unit a includes a resistor R1, an amplifier Amp1 which has an inverting input terminal receiving the input voltage Vi through the resistor R1 and a grounded non-inverting input terminal, and a capacitor C2 and a resistor R2 connected in parallel to feed the output voltage V11 from the amplifier Amp1 back to the inverting input terminal of the amplifier Amp1. The voltage amplification unit a is an element which amplifies the output voltage Vi from the current sensing unit 24 since its scale is low. The relation between the input voltage V1 and the voltage V11 in the voltage amplification unit a can be represented by the following Formula 3:

$$V11 = -\frac{Z2}{R1}Vi \qquad \text{Formula 3}$$

wherein Z2=(R2□C2), which corresponds to a parallel impedance of the resistor R2 and the capacitor C2. Additionally, for example, a cut-off frequency by the capacitor C2 and the resistor R2 is set below 1 kHz, which serves to remove switching noise or the like generated and contained in the previous step or element.

The coupling unit b includes a capacitor C5 removing the DC offset and a resistor R5 connected in series to the capacitor C5 to stabilize a waveform of the voltage V11.

The integration unit c includes an amplifier Amp2, which has an inverting input terminal receiving the voltage V11 through the coupling unit b and a non-inverting input terminal receiving a reference voltage Vref, and a capacitor C6 and a resistor R6 connected in parallel to feed the output voltage V44 from the amplifier Amp2 back to the inverting input terminal of the amplifier Amp2.

The reference voltage Vref to the non-inverting input terminal of the amplifier Amp2 is determined by the following Formula 4:

$$Vref = \frac{Rb}{Ra + Rb}Vd \qquad \text{Formula 4}$$

wherein Vd denotes a DC voltage which is e.g. 15 V, and the reference voltage Vref can be set as e.g. 2.5 V by adjusting a rate of a resistor Ra to Rb. The reference voltage Vref is input to the non-inverting input terminal through a resistor R20. With their DC component removed by the coupling unit b, an AC waveform is fluctuated upward or downward about 0 V. This voltage waveform is fluctuated upward or downward about the reference voltage Vref by the reference voltage Vref, which facilitates the processing of the control unit 28 including the microprocessor, etc. to a desired magnitude between 0 V and 5 V. This reference voltage Vref also corresponds to an input voltage level of the control unit 28.

The cut-off frequency (=1/(2πC6×R6)) determined by the resistor R6 and the capacitor C6 should be set lower than a current frequency (e.g. the current flowing through the motor 23) and/or an operating frequency. If the cut-off frequency is set higher than the input current frequency or operating frequency, the resistor R6 and the capacitor C6 operate as an LPF. That is, when the cut-off frequency is set low, they can serve as an integrator.

The voltage V11, the reference voltage Vref and the voltage V44 satisfy the relation based on the following Formula:

$$V44 = \left(1 + \frac{Z6}{Z5}\right)Vref - \frac{Z6}{Z5}V11 \qquad \text{Formula 5}$$

wherein Z5 denotes an impedance by the capacitor C5 and the resistor R5, and Z6 denotes an impedance by the capacitor C6 and the resistor R6.

$$V11 = \left(1 + \frac{R2}{R1}\right)Vref - \frac{R2}{R1}Vi \qquad \text{Formula 6}$$

The LPF unit d includes a resistor R9 receiving a voltage V44 and a capacitor C9 having one end connected to the resistor R9 and the other end grounded. The LPF unit d is to remove a high-frequency noise component superimposed on an applied voltage waveform. For example, it can remove switching noise over 5 kHz.

As a result, a voltage Vo without noise is applied to the control unit 28.

When receiving a starting command of the linear compressor from an external source or receiving AC commercial power, the control unit 28 generates a control signal for transferring a preset application voltage Vin to the motor 23 and applies the control signal to the inverter unit 22. Accordingly, the inverter unit 22 generates an AC voltage corresponding to the application voltage Vin and applies the AC voltage to the motor 23.

The current sensing unit 24 senses a current i flowing from the inverter unit 22 to the motor 23 or a current i flowing through a coil L of the motor 23 by the application of this AC voltage and applies an input voltage Vi corresponding to this current i to the integrator circuit unit 27.

The integrator circuit unit 27 receives the voltage Vi from the current sensing unit 24, performs the processing using the aforementioned elements, and applies a voltage Vo to the control unit 28.

The capacitor C2 used in the prior art can operate when its capacity is remarkably larger than that of the capacitors C2, C5, C6, and C9 shown in FIGS. 11 and 12.

Figure 13:
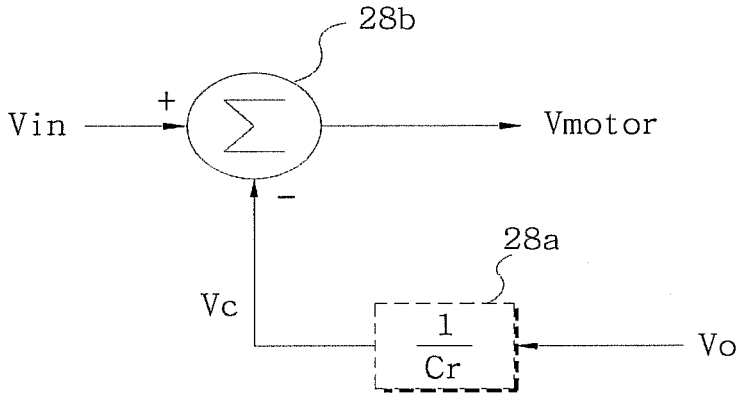
FIG. 13 is a circuit diagram of a control example of a control unit of FIG. 11.

FIG. 13 is a circuit diagram of a control example of the control unit of FIG. 11. As illustrated in FIG. 13, the control unit 28 includes an attenuator 28*a* operating an attenuation voltage Vc by multiplying the voltage Vo by a constant 1/Cr and an operation unit 28*b* operating a difference between the set application voltage Vin and the attenuation voltage Vc. The application voltage Vin of this embodiment, which corresponds to the voltage applied by the inverter unit in the conventional compressor, is fixed or varied according to the control algorithm of the linear compressor.

The integrator circuit unit 27 and the attenuator 28*a* correspond to an attenuation operation unit which attenuates the inductance effect of the coil L of the motor, using the current i flowing through the motor 23. That is, in this embodiment, since there is no capacitor connected to the coil L of the motor 23, the inductance effect of the coil L is reduced by controlling the motor application voltage Vmotor applied to the motor 23.

In addition, the attenuator 28*a* may be selectively provided. In other words, this constant 1/Cr may be reflected in the integration of the voltage Vo, in which case the voltage Vo and the voltage Vc are the same. Or, the control unit 28 may include the attenuator 28*a* to calculate the voltage Vc by multiplying the voltage Vo by the constant 1/Cr. It is apparent that this process can adjust or change the cooling capacity variability (modulation) rate by varying the constant Cr as explained with FIG. 9.

As such, after operating the motor application voltage Vmotor, the control unit 28 generates a control signal for controlling the inverter unit 22 to transfer the operated motor application voltage Vmotor to the motor 23 and applies the control signal to the inverter unit 22. That is, as the control unit 28 allows the sensed current i to be fed back to the motor application voltage Vmotor, it is able to control the operation of the motor 23 without having a capacitor connected to the motor 23. In the present invention, since the counter EMF is reflected to the current i and fed back, it can be ignored. Thereafter, the control unit 28 repeatedly calculates and provides the motor application voltage Vmotor according to a difference between the application voltage Vin which is an initial voltage and the attenuation voltage which is obtained by integrating the current produced by the applied motor application voltage Vmotor (e.g., a first attenuation voltage by the application voltage Vin, a second attenuation voltage by the primarily-calculated motor application voltage Vmotor, etc.).

The higher the load, the greater the motor application voltage Vmotor which is the required voltage. In the present invention, if the motor application voltage Vmotor (i.e., the maximum value) which is the required voltage is smaller than the DC voltage Vdc, the current state is determined as a low or mid load. In the case of the low or mid load, the inverter unit 22 applies an AC voltage (motor application voltage Vmotor) having a magnitude equal to or smaller than the DC voltage Vdc to the motor 23. Hence, the control unit 28 can maintain the required cooling capacity by adjusting the magnitude of the AC voltage applied from the inverter unit 22 to the motor 23.

Further, the control unit 28 can attain as a high cooling capacity as required by varying a frequency of the motor application voltage Vmotor from the inverter unit 22, e.g., by increasing a frequency at a high load.

Figure 14:
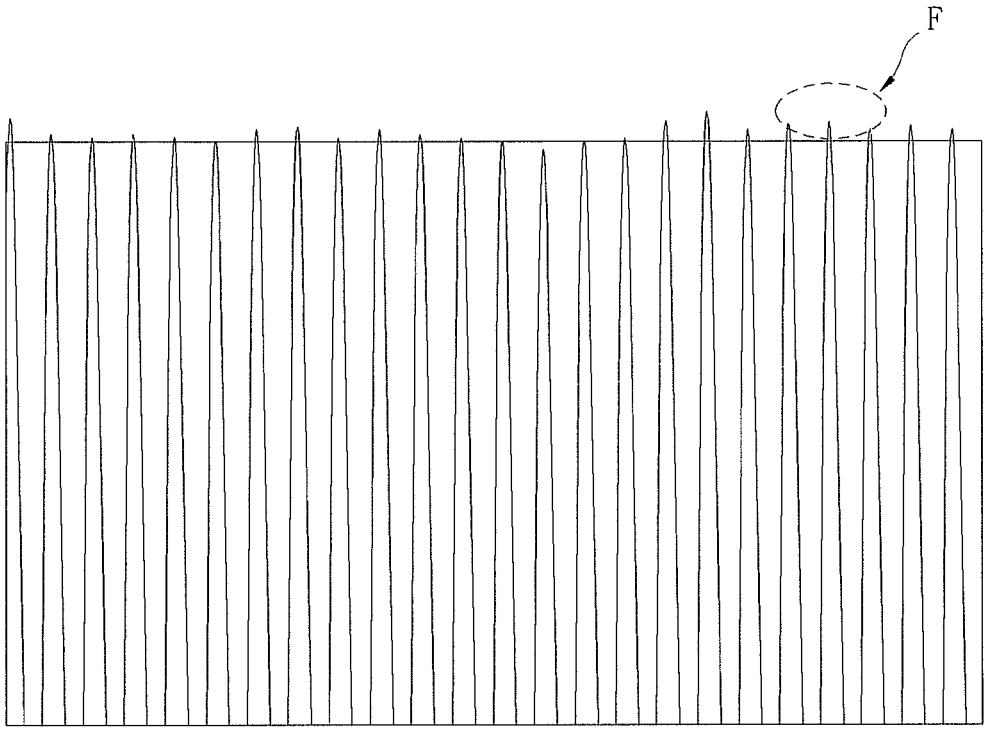
FIG. 14 is a graph showing a waveform of an attenuation voltage Vc in the control device of FIGS. 4 to 6.

FIG. 14 is a graph showing a waveform of the attenuation voltage Vc in the control device of FIGS. 4 to 6(first embodiment). As shown in FIG. 14, it can be seen that fluctuation often occurs in a region F of the control device according to the first embodiment.

Figure 15:
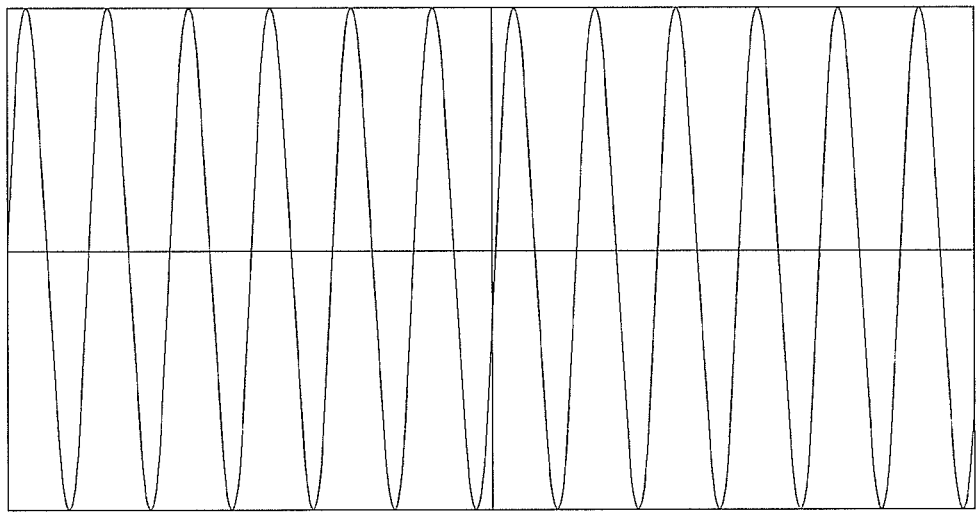
FIG. 15 is a graph showing a waveform of an attenuation voltage Vc or Vo in the control device of FIGS. 11 to 13.

FIG. 15 is a graph showing a waveform of the attenuation voltage Vc or Vo in the control device of FIGS. 11 to 13(second embodiment). As shown in FIG. 15, it can be seen that fluctuation seldom occurs in the voltage waveform of the control device according to the second embodiment. The control unit can precisely control the motor based on this stable voltage waveform, and the cooling capacity itself does not have scattering.

The present invention has been described in detail with reference to the exemplary embodiments and the attached drawings. However, the scope of the present invention is not limited to such embodiments and drawings, but is defined by the appended claims.

What is claimed is:

1. A linear compressor, comprising:

a mechanical unit including a fixed member having a compression space therein, a movable member linearly reciprocated in the fixed member to compress a refrigerant sucked into the compression space, one or more springs provided to elastically support the movable member in a motion direction of the movable member, and a motor connected to the movable member to linearly reciprocate the movable member in an axial direction; and an electric control unit including a rectification unit receiving AC power and outputting a DC voltage, an inverter unit receiving the DC voltage, converting the DC voltage to an AC voltage according to a control signal, and supplying the AC voltage to the motor, a current sensing unit sensing a current flowing between the motor and the inverter unit, an integrator circuit unit integrating a voltage corresponding to the current sensed by the current sensing unit, and a control unit receiving an integrated value from the integrator circuit unit and controlling the AC voltage applied to the motor to permit the reciprocation of the movable member.

2. The linear compressor of claim 1, wherein the control unit generates the control signal for producing the AC voltage such that it corresponds to a difference between a set voltage and an attenuation voltage corresponding to the integrated value, and applies the control signal to the inverter unit.

3. The linear compressor of claim 2, wherein the control unit operates the attenuation voltage by multiplying the integrated value by a constant constant 1/Cr, wherein Cr corresponds to a capacitance.

4. The linear compressor of claim 3, wherein the control unit adjusts a cooling capacity variability rate by varying the constant 1/Cr.

5. The linear compressor of claim 1, wherein the integrator circuit unit comprises an integration unit receiving a reference voltage Vref which is greater than 0 V and outputting the integrated value which is varied about the reference voltage Vref.

6. The linear compressor of claim 1, wherein the integration unit comprises an amplifier which has an inverting input terminal receiving the voltage from the current sensing unit and a non-inverting input terminal receiving a reference voltage Vref, and a capacitor and a resistor connected in parallel to feed an output voltage from the amplifier back to the inverting input terminal.

7. The linear compressor of claim 6, wherein a cut-off frequency determined by the capacitor and the resistor connected in parallel is set lower than a current frequency or an operating frequency.

8. The linear compressor of claim 5, wherein the integrator circuit unit comprises a voltage amplification unit amplifying the voltage corresponding to the current from the current sensing unit and a coupling unit cutting off a DC offset contained in an output voltage from the voltage amplification unit, prior to the integration unit, and provides an output from the coupling unit as an input to an inverting input terminal of the integration unit.

9. The linear compressor of claim 8, wherein the integrator circuit unit comprises a low-pass filter unit removing noise contained in an output voltage from the integration unit.

10. A method for controlling a linear compressor which includes a fixed member having a compression space therein, a movable member provided in the fixed member to compress a refrigerant sucked into the compression space, one or more springs provided to elastically support the movable member, and a motor connected to the movable member to linearly reciprocate the movable member in an axial direction, the method comprising:

a first step of applying a preset application voltage to the motor;

a second step of generating a first input voltage corresponding to a current produced by the application of the preset application voltage;

a third step of calculating a first output voltage by integrating the first input voltage;

a fourth step of calculating a first attenuation voltage by attenuating the first output voltage at a given ratio;

a fifth step of calculating a first motor application voltage corresponding to a difference between the present application voltage and the first attenuation voltage; and a sixth step of applying the first motor application voltage to the motor.

11. The method of claim 10, wherein the second to sixth steps are repeatedly performed.

12. The method of claim 10, wherein the third step and the fourth step are performed at the same time.

13. The method of claim 10, wherein the third step receives a reference voltage Vref which is greater than 0 V and calculates the first output voltage such that it is varied about the reference voltage Vref.

14. The method of claim 13, wherein the third step performs the integration using a cut-off frequency which is lower than a current frequency or an operating frequency.

15. The method of claim 10, wherein the given ratio is variable according to a cooling capacity variability rate.

* * * * *